US008590616B1

(12) United States Patent
McClinton et al.

(10) Patent No.: US 8,590,616 B1
(45) Date of Patent: Nov. 26, 2013

(54) CAGED BALL FRACTIONATION PLUG

(71) Applicants: Tony D. McClinton, Odessa, TX (US); Stanley Keeling, Odessa, TX (US); Buster Carl McClinton, Odessa, TX (US)

(72) Inventors: Tony D. McClinton, Odessa, TX (US); Stanley Keeling, Odessa, TX (US); Buster Carl McClinton, Odessa, TX (US)

(73) Assignee: Tony D. McClinton, Odessa, TX (US)

( * ) Notice: Subject to any disclaimer, the term of this patent is extended or adjusted under 35 U.S.C. 154(b) by 0 days.

(21) Appl. No.: 13/774,727

(22) Filed: Feb. 22, 2013

Related U.S. Application Data

(60) Provisional application No. 61/602,031, filed on Feb. 22, 2012.

(51) Int. Cl.
*E21B 33/129* (2006.01)

(52) U.S. Cl.
USPC ..... 166/135; 166/193

(58) Field of Classification Search
USPC ..... 166/118, 133, 135, 193, 124
See application file for complete search history.

(56) References Cited

U.S. PATENT DOCUMENTS

| | | | | |
|---|---|---|---|---|
| 4,437,516 | A | 3/1984 | Cockrell | |
| 4,595,052 | A | 6/1986 | Kristiansen | |
| 5,224,540 | A | 7/1993 | Streich et al. | |
| 6,220,349 | B1 | 4/2001 | Vargus et al. | |
| 6,491,108 | B1 | 12/2002 | Slup et al. | |
| 6,581,681 | B1 | 6/2003 | Zimmerman et al. | |
| 6,796,376 | B2 | 9/2004 | Frazier | |
| 7,350,582 | B2 | 4/2008 | McKeachnie et al. | |
| 7,740,079 | B2 * | 6/2010 | Clayton et al. | 166/387 |
| 8,079,413 | B2 | 12/2011 | Frazier | |
| D657,807 | S | 4/2012 | Frazier | |
| 8,459,346 | B2 | 6/2013 | Frazier | |
| 2007/0151722 | A1 | 7/2007 | Lehr et al. | |
| 2010/0155050 | A1 | 6/2010 | Frazier | |

* cited by examiner

*Primary Examiner* — David Andrews
(74) *Attorney, Agent, or Firm* — Buskop Law Group, PC; Wendy Buskop

(57) ABSTRACT

A caged ball fractionation plug for use in a wellbore with a crown engagement having a tapered nose cone and various load ring, slips, slip backups, lubricating spacers and seals can all be slidably engaged to the mandrel. Upon applying pressure, the slidably engaged components can be compressed against each other and the plug can expand and bite into the casing of the wellbore. The caged ball portion of the plug seats the ball internal to the plug to create two separate fractionation zones in the wellbore.

8 Claims, 8 Drawing Sheets

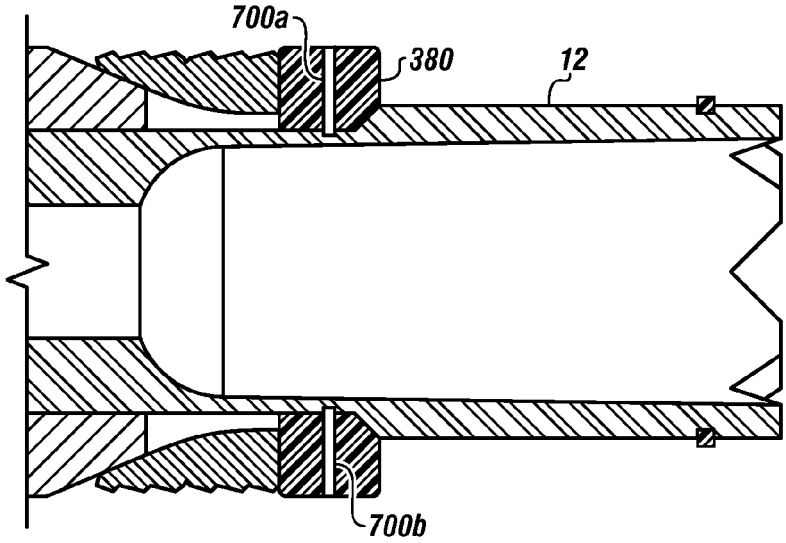
FIGURE 6
FIGURE 7
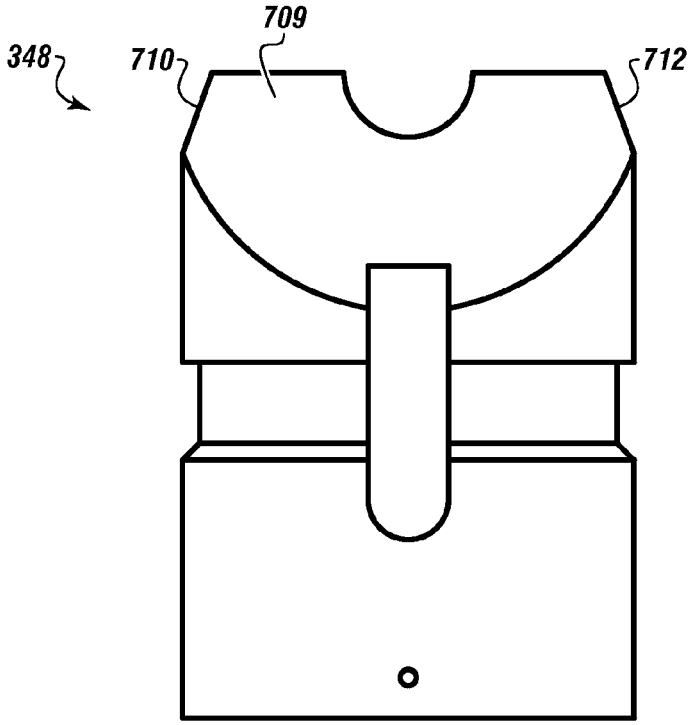

CAGED BALL FRACTIONATION PLUG

CROSS REFERENCE TO RELATED APPLICATION

The current application claims priority to and the benefit of co-pending U.S. Provisional Patent Application Ser. No. 61/602,031 filed on Feb. 22, 2012, entitled "CAGED BALL FRACTIONATION PLUG". This reference is incorporated in its entirety.

FIELD

The present embodiments generally relate to a caged ball fractionation plug for use in fractionation of a wellbore.

BACKGROUND

A need exists for a fractionation plug which can avoid becoming preset in the wellbore, especially when performing directional drilling or if there are variations in elevation of the wellbore, while simultaneously separating the wellbore into separate zones.

A further need exists for a fractionation plug that can quickly and securely engage with the crown engagement of another fractionation plug, and prevent fractionation plugs from spinning during drill-out.

The present embodiments meet these needs.

BRIEF DESCRIPTION OF THE DRAWINGS

The detailed description will be better understood in conjunction with the accompanying drawings as follows:

FIG. 6 depicts a cross sectional view of a load ring disposed about a mandrel wherein one or more set screws are disposed through the load ring.

FIG. 7 depicts a tapered nose cone having a beveled distal end.

Figure 1A:
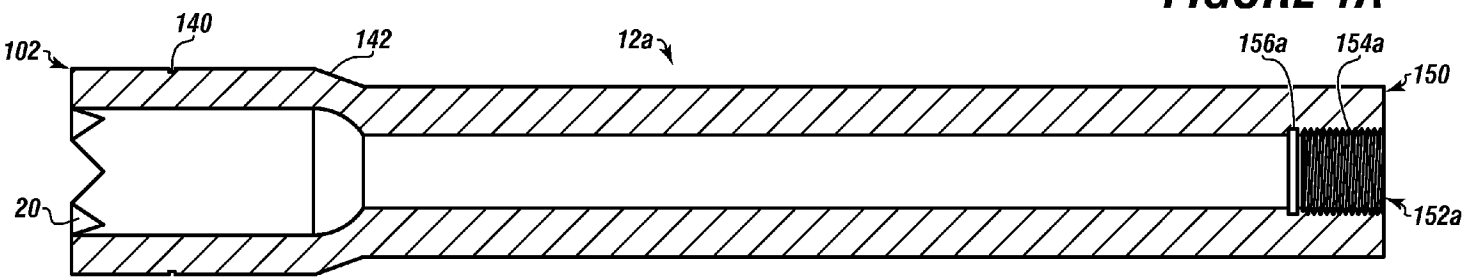
FIG. 1A depicts a mandrel according to one or more embodiments.

The present embodiments are detailed below with reference to the listed figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a fractionation plug with a caged ball configuration. The fractionation plug with a caged ball setting mechanism can be used in a wellbore and can include a mandrel.

The caged ball configuration of the fractionation plug can allow a work over team to pressure up on well bore casing before perforating a fractionation zone to ensure that the plug is holding; enabling successful separation of two zones adjacent the pay zone.

The caged ball configuration can allow pressure to flow back from a lower zone through the fractionation plug without having to drill out the fractionation plug.

The mandrel can include a crown engagement and a setting mechanism receiving end.

The crown engagement can have a diameter larger than the setting mechanism receiving end.

A mandrel shoulder can be formed between the crown engagement and the setting mechanism receiving end. A load ring can rest on the mandrel shoulder.

A first slip can be adjacent to the load ring. A first slip backup can be adjacent to the first slip. A first lubricating spacer can be adjacent to the first slip backup and a first secondary seal.

A primary seal can be adjacent to the first secondary seal. A second secondary seal can be adjacent to the primary seal.

A second lubricating spacer can be adjacent to the second secondary seal, which can include a second slip backup adjacent to the second lubricating spacer. The second slip can be adjacent to the second slip backup.

A removable nose cone can be disposed over the mandrel and can be adjacent to the second slip backup.

The removable nose cone can include a double bevel or tapered engagement. The tapered engagement can be composed of a first sloped face, a second sloped face, and a tapered face.

A central opening can be formed in the center of the sloped faces of the tapered engagement. The tapered engagement can be integrated with a nose cone body which can form a pump down ring groove.

An embodiment can include a plurality of pressure relief grooves which can extend longitudinally. The pressure relief grooves can be disposed on an outer surface of the tapered engagement.

A facial seal can be formed in the setting mechanism receiving end of the mandrel where a caged ball setting mechanism can be threaded into the setting mechanism receiving end between the facial seal and the removable nose cone.

The caged ball setting mechanism can engage the facial seal. The caged ball setting mechanism can also include a setting mechanism load shoulder.

An extension can extend from the setting mechanism load shoulder into the removable nose cone. For example, in one or more embodiments the extension can be about 0.47 inches long from the setting mechanism load shoulder to the face of the extension.

Engaging threads can extend over an outer surface of the caged ball setting mechanism body. The engaging threads can extend over at least a portion of the caged ball setting mechanism body.

The engaging threads of the caged ball caged ball setting mechanism can screw into the internal threads of the setting mechanism receiving portion.

The caged ball setting mechanism body can include a first caged ball chamber with a first diameter and a second caged ball chamber with a second diameter. The engaging threads can extend into the caged ball setting mechanism first chamber covering part or the entire thereof, such as extending 0.59 inches into the chamber.

The second diameter can be larger than the first diameter, which can create a caged ball shoulder. For example, in one or more embodiments the first diameter can be 0.95 inches and the second diameter can be 1.145 inches.

Shear threads can be formed around the second caged ball chamber.

A caged ball seat can be formed in the interface between the first caged ball chamber and the extension. The caged ball seat can have a first diameter which can be smaller than the first caged ball chamber diameter. A caged ball seat guide can be adjacent the caged ball seat.

A caged ball retaining rod can be adjacent the first caged ball chamber. The caged ball retaining rod can prevent the caged ball from exiting the first caged ball chamber.

The caged ball setting mechanism can have a second caged ball chamber. The second caged ball chamber can have a second diameter which can be larger than the first diameter of the first caged ball chamber.

Shear threads can be formed around the second caged ball chamber.

The caged ball setting mechanism can include a caged ball retaining rod which can have a diameter less than the central opening.

The caged ball setting mechanism can have a caged ball body with various thread coverage and thread spacing, such as a caged ball body that is all threaded, with threads at twenty threads per inch.

The caged ball setting mechanism can have left handed threads. The left handed threading can be used to prevent loosening of the caged ball setting mechanism, such as when the setting rod is inserted and tightened into the second caged ball chamber.

Turning now to the Figures, FIG. 1A depicts a mandrel according to one or more embodiments.

The mandrel 12*a* can be used to form a portion of the bridge fractionation plug.

The mandrel 12*a* can have a first end 102 and a second end 150. The mandrel 12*a* can have an overall length from 1 foot to 4 feet. The outer diameter of the mandrel 12*a* can be from 2 inches to 10 inches.

The mandrel 12*a* can have a crown engagement 20 formed in the first end 102.

The first end 120 can have a first diameter that is larger than a second diameter of the second end 150. For example, in one or more embodiments, the first diameter can be 0.75 inches and the second diameter can be 2.25 inches for a 3½ inch mandrel.

A mandrel shoulder 142 can be formed between the first end 102 and the second end 150. The mandrel shoulder 142 can be of varying angles, such as from about 10 degrees to about 25 degrees.

The second end 150 can have a first setting mechanism receiving portion 152*a*, which can have a facial seal 156*a* and first internal threads 154*a*. The facial seal can be made from an elastomer, urethane, TEFLON™ brand polytetrafluoroethylene, or similar durable materials. The facial seal 156*a* can be one or more of O-rings, E-rings, C-rings, gaskets, end face mechanical seals, or combinations thereof. The first setting mechanism receiving portion can be used when the operating pressure is less than 8,000 psi. Any plug described herein can be used with the first setting mechanism receiving portion 152*a*.

An anti-rotation ring groove 140 can be formed into the first end 102. The anti-rotation ring groove 140 can secure an anti-rotation ring, not shown in this Figure, about the mandrel 12*a*. The anti-rotation groove prevents the fractionation plug from becoming loose and falling off of a plug setting mechanism. The anti-rotation groove creates a tight fit between the anti-rotation seal and the fractionation plug setting sleeve. The anti-rotation ring can made from elastomeric, TEFLON™ brand polytetrafluoroethylene, urethane, or a similar sealing material that is durable and able to handle high temperatures.

Figure 1B:
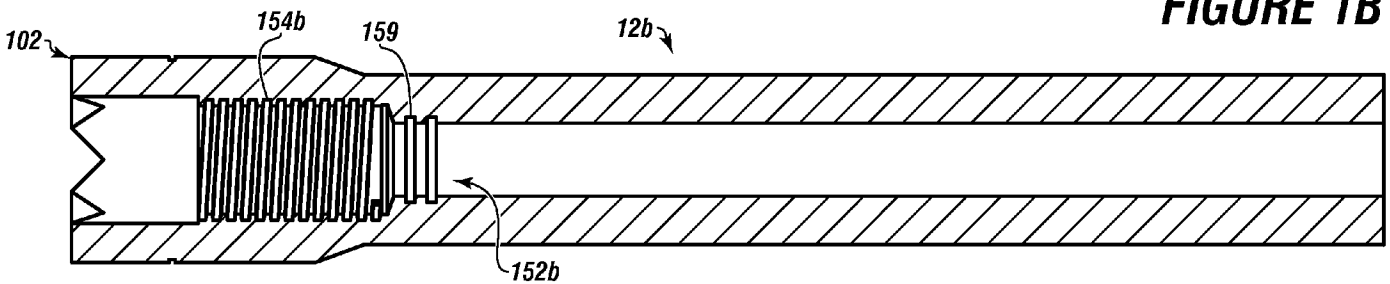
FIG. 1B depicts another embodiment of a mandrel.

FIG. 1B depicts another embodiment of a mandrel 12*b*. The mandrel 12*b* can be substantially similar to the mandrel 12*a*. The mandrel 12*b*, however, can have a second setting mechanism receiving portion 152*b* formed adjacent to the first end 102. The second setting mechanism receiving portion 152*b* can have one or more seals 159. The second setting mechanism receiving portion 152*b* can be used at any pressure. Any plug described herein can be used with the second setting mechanism receiving portion 152*b*. The second setting mechanism receiving portion 152*b* can have second internal threads 154*b*.

Figure 1C:
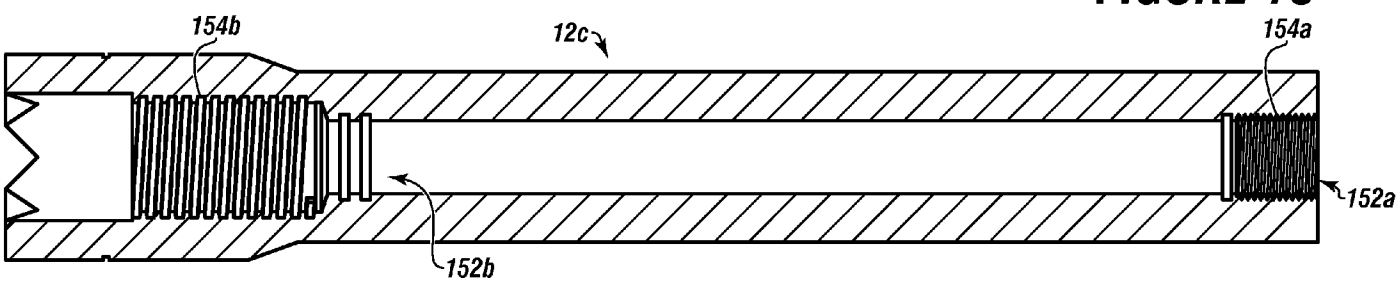
FIG. 1C depicts an additional mandrel according to one or more embodiments.

FIG. 1C depicts another embodiment of a mandrel 12*c*. The mandrel 12*c* can be substantially similar to the mandrel 12*a*, but can include the first setting mechanism receiving portion 152*a* and the second setting mechanism receiving portion 152*b*. Any plug described herein can be used with the first setting mechanism receiving portion 152*a* and the second setting mechanism receiving portion 152*b*. The first setting mechanism receiving portion 152*a* can have first internal threads 154*a*, and the second setting mechanism receiving portion 152*b* can have second internal threads 154*b*.

Figure 2:
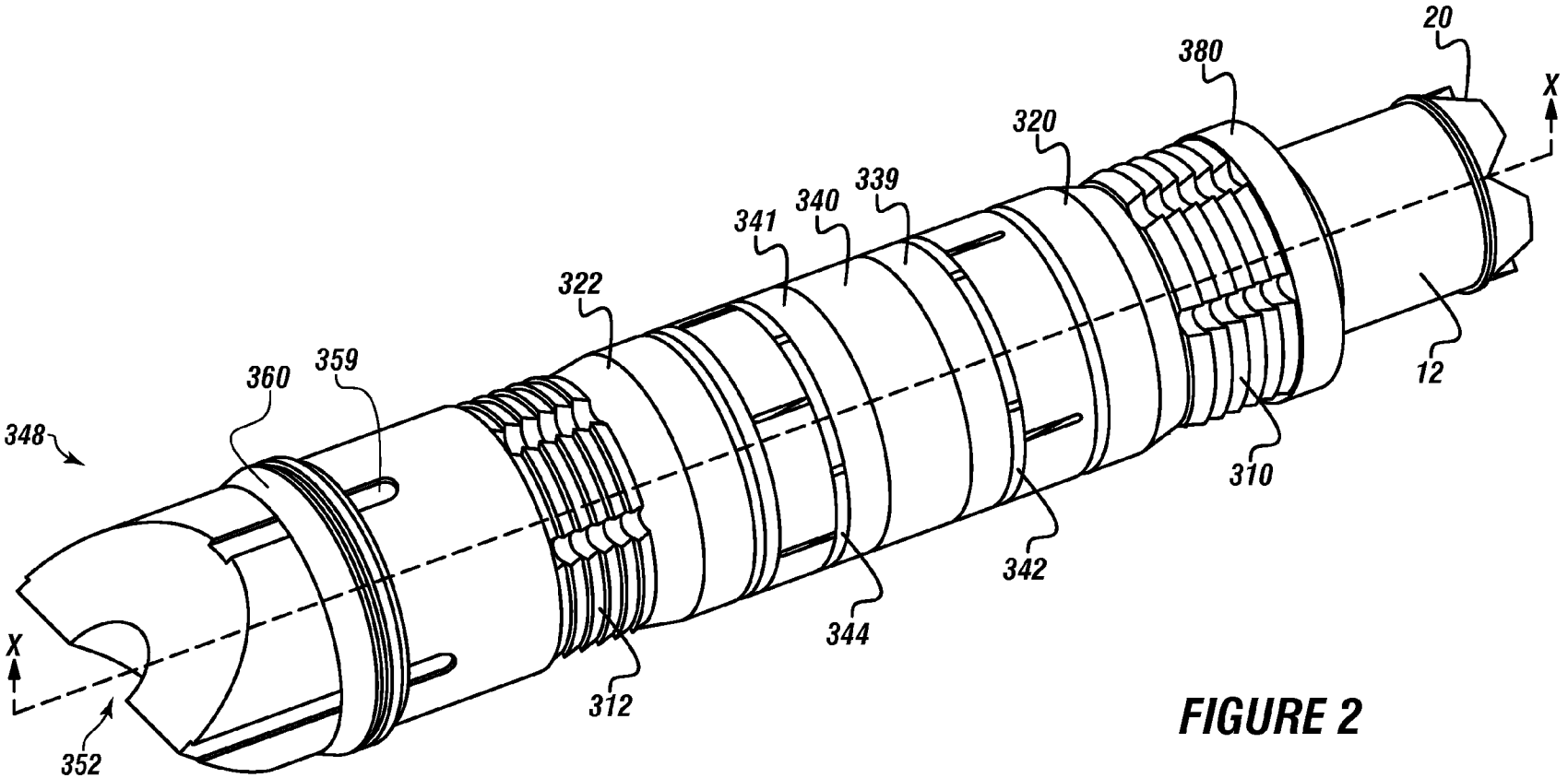
FIG. 2 is an isometric view of an illustrative fractionation plug according to one or more embodiments.

FIG. 2 is an isometric view of an illustrative fractionation plug according to one or more embodiments.

The fractionation plug can include a mandrel 12 which can be any mandrel described herein. One or more slips, such as a first slip 310 and a second slip 312, can be disposed on the mandrel 12.

The slips 310 and 312 can be made from metallic or non-metallic material. The slips 310 and 312 can have segments that bite into the inner diameter of a casing of a wellbore. The first slip 310 can be adjacent a load ring 380, and the second slip 312 can be adjacent a removable nose cone 348. The first slip 310 and the second slip 312 can be bidirectional slips, unidirectional slips, or any other slips that are used in downhole operations.

The mandrel 12 can also have one or more slip backups disposed thereon. A first slip backup 320 can be adjacent to the first slip 310. At least a portion of the first slip backup 320 can be tapered to at least partially nest within a portion of the inner diameter of the first slip 310. A second slip backup 322 can be adjacent the second slip 312. At least a portion of the second slip backup 322 can be tapered to at least partially nest within a portion of the inner diameter of the second slip 312. The slip backups can force the adjacent slip to expand into the inner diameter of the casing of the wellbore.

The slip backups can expand the first secondary seal 339, the second secondary seal 341, and the large primary seal 340. These seals can be made of any sealing material. Illustrative sealing material can include rubber, elastomeric material, composite material, or the like. These seals can be configured to withstand high temperatures, such as 180 degrees Fahrenheit to 450 degrees Fahrenheit.

A first lubricating spacer 342 and a second lubricating spacer 344 can be disposed on the mandrel 12. The lubricating spacers can be made of a material that can allow free movement of the adjacent components such as TEFLON™ brand polytetrafluoroethylene, plastic, polyurethane. The first and second lubricating spacers are each tapered on one side and fit into the slip backups. The first and second lubricating spacers can range in length from 1 inch to 3 inches.

The first lubricating spacer 342 can be disposed adjacent the first slip back-up 320. The first lubricating spacer 342 can be disposed between the first slip back-up 320 and the first secondary seal 339.

The second lubricating spacer 344 can be disposed about the mandrel 12 adjacent the second slip backup 322. The second lubricating spacer 344 can be disposed between the large seal 340 and the second slip backup 322.

The mandrel 12 can also have a removable nose cone 348 disposed thereon. The removable nose cone 348 can have one or more pressure relief grooves 359 formed therein. The removable nose cone 348 can be of various lengths and have faces of various angles. The removable nose cone can be 6 inches long and can have a first sloped face of 45 degrees and a second sloped face of 45 degrees tapering to a point together. The removable nose cone 348 can have a central opening 352. The diameter of the central opening can range from ⅝ of an inch to 2 inches. The removable nose cone 348 can be disposed about or connected with the mandrel 12 opposite the crown engagement 20. A pump down ring 360 can be disposed about the removable nose cone 348.

The load ring 380 can be disposed about the mandrel 12 adjacent or proximate to the crown engagement 20. The load ring 380 can reinforce a portion of the mandrel 12 to enable the mandrel 12 to withstand high pressures. The load ring 380 can be made from a composite material containing glass and epoxy resin cured material that is able to be machined, milled, cut, or combinations thereof. The load ring can be from 1 inch to 3 inches in length and 2 inches to 8 inches in diameter.

Figure 3:
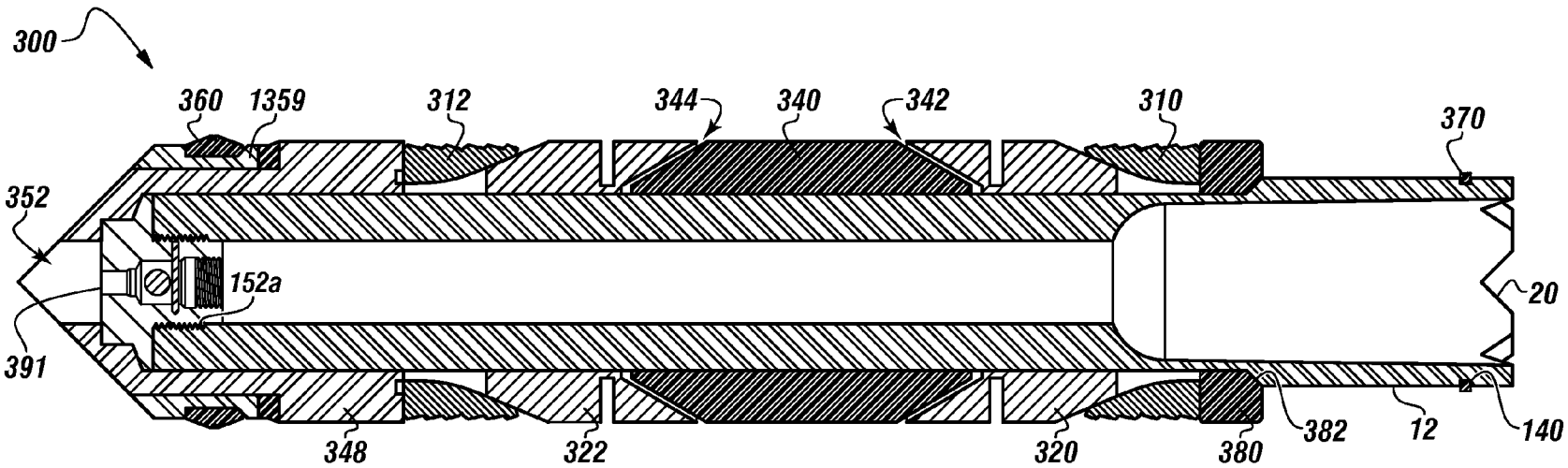
FIG. 3 is cut view of the fractionation plug along X-X with a caged ball setting mechanism inserted therein.

FIG. 3 is a cut view of the fractionation plug of FIG. 2 along line X-X with a caged ball setting mechanism inserted therein.

The fraction plug 300 can include the mandrel 12. The mandrel 12 can have a first setting mechanism receiving portion 152*a*.

A caged ball setting mechanism 391 can be inserted in the first setting mechanism receiving portion 152*a*. The caged ball setting mechanism 391 can threadably connect to the first setting mechanism receiving portion 152*a*. The caged ball setting mechanism 391 can be any caged ball setting mechanism, such as those described herein.

The removable nose cone 348 can be supported by the mandrel, the caged ball setting mechanism 391, or any combination thereof.

An anti-rotation ring 370 can be secured in the anti-rotation ring groove 140.

The load ring 380 can use a load ring seat 382 to rest on a mandrel load shoulder.

Also shown are pump down ring 360, the pump down ring groove 1359, the first slip 310, the second slip 312, the first slip backup 320, the second slip backup 322, a large primary seal 340, the first lubricating spacer 342, the second lubricating spacer 344, and the central opening 352.

The crown engagement 20 is also viewable in this Figure. The crown can be integral with the mandrel 12 as a one piece structure. In an embodiment, such as the 4½ inch in diameter mandrel, the crown can have 6 grooves formed by 6 points that extend away from the mandrel 12 create an engagement that securely holds another nose cone to the plug for a linear connection of two plugs in series.

Figure 4A:
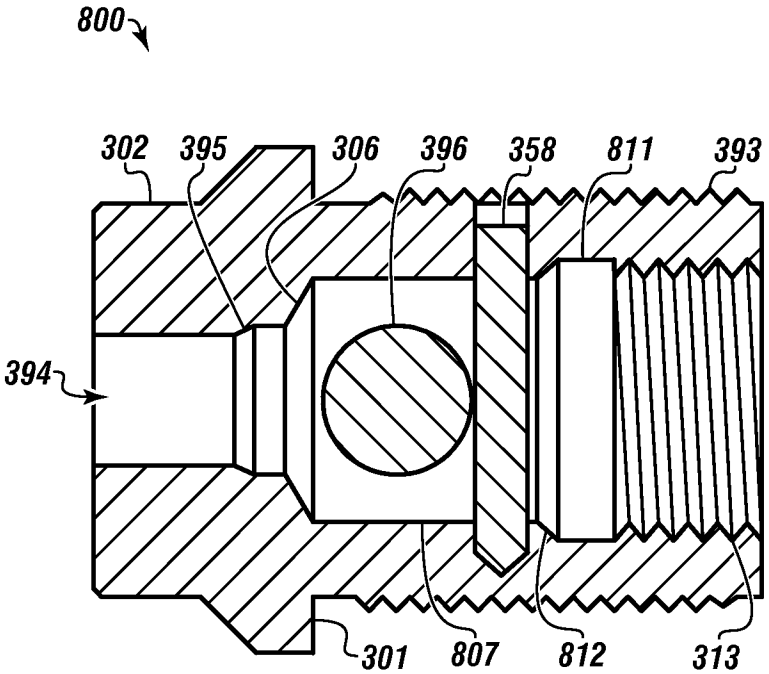
FIG. 4A depicts a schematic of a first caged ball setting mechanism according to one or more embodiments.

FIG. 4A depicts a schematic of a first caged ball setting mechanism 800 according to one or more embodiments.

The first caged ball setting mechanism 800 can include an extension 302 with an extension portal 394, a caged ball retaining rod 358 and a caged ball 396. The extension portal 394 can be used to allow for differential pressure between zones in a wellbore.

The caged ball setting mechanism 800 can also include the setting mechanism load shoulder 301 and the engaging threads 393.

The first caged ball setting mechanism 800 can have a caged ball chamber 807 with a first diameter. The caged ball retaining rod 358 can be secured adjacent to the caged ball chamber 807. The caged ball retaining rod 358 can keep the caged ball 396 within the caged ball chamber 807.

An upper chamber 811 can be formed into the first caged ball setting mechanism 800. The caged ball chamber 807 can have a smaller diameter than the upper chamber 811.

A setting tool stop 812 can be formed between the caged ball retaining rod 358 and the upper chamber 811.

The upper chamber 811 can have shear threads 313 to engage with the setting rod.

The first caged ball setting mechanism 396 can be guided by a caged ball seat guide 306 into the caged ball seat 395 when fluid pressure is applied.

Figure 4B:
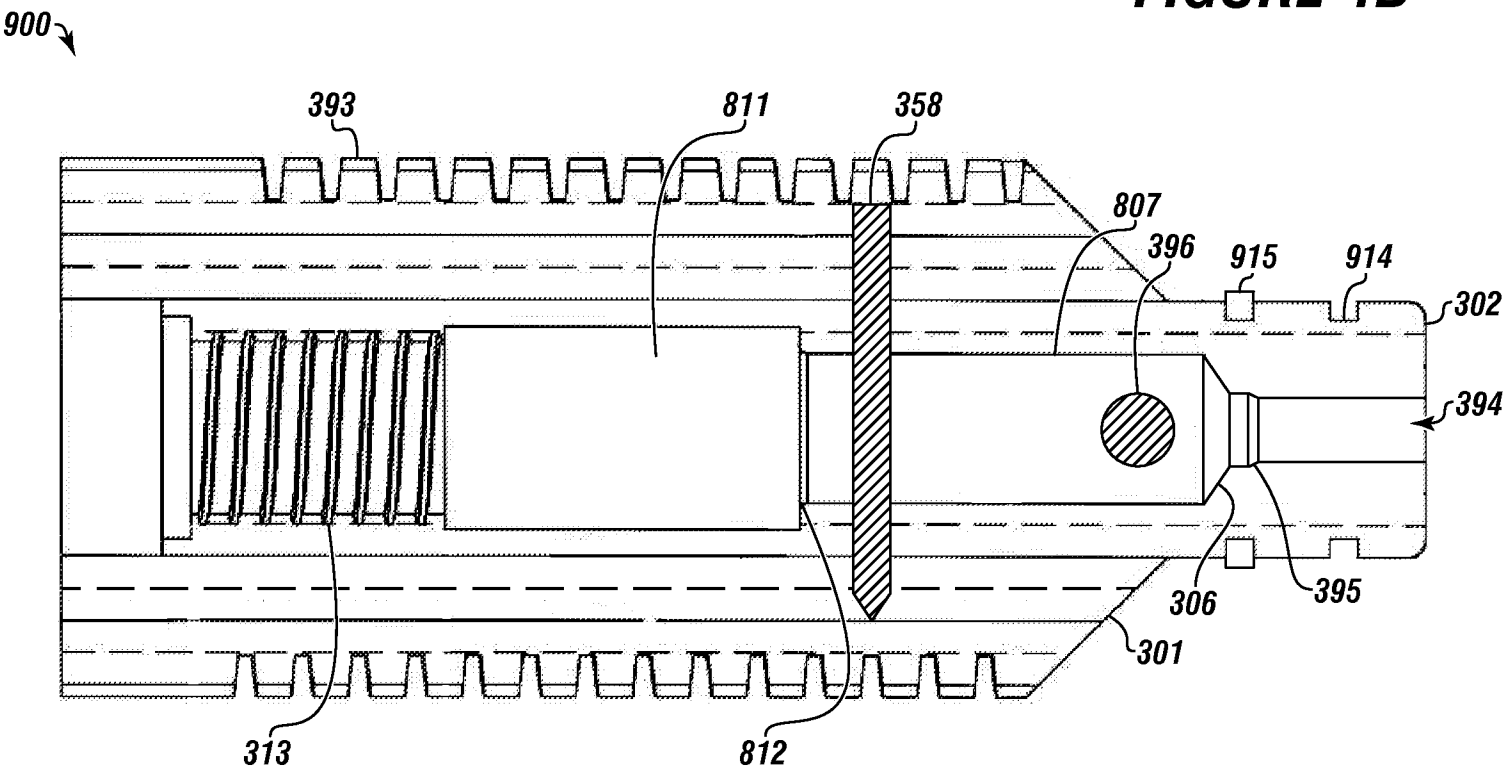
FIG. 4B depicts a schematic of a second caged ball setting mechanism according to one or more embodiments.

FIG. 4B depicts a schematic of a second caged ball setting mechanism 900 according to one or more embodiments.

The second caged ball setting mechanism 900 can include the extension 302 with the extension portal 394, a caged ball retaining rod 358, and a caged ball 396. The extension portal 394 can be used to allow for differential pressure between zones in a wellbore.

The second caged ball setting mechanism 900 can also include the setting mechanism load shoulder 301 and the engaging threads 393.

The second caged ball setting mechanism 900 can have a caged ball chamber 807 with a first diameter. A caged ball retaining rod 358 can be secured adjacent to the caged ball chamber 807. The caged ball retaining rod 358 can keep the caged ball 396 within the caged ball chamber 807.

An upper chamber 811 can be formed into the second caged ball setting mechanism 900. The caged ball chamber 307 can have a smaller diameter than the upper chamber 811.

A setting tool stop 812 can be formed between the caged ball retaining rod 358 and the upper chamber 811.

The upper chamber 811 can have shear threads 313 to engage with the setting rod.

The caged ball 396 can be guided by a caged ball seat guide 306 into the caged ball seat 395 when fluid pressure is applied.

The extension 302 can include one or more seal grooves 914. Each seal groove can have a seal 915 secured therein. The seals can be O-rings or the like.

Figure 4C:
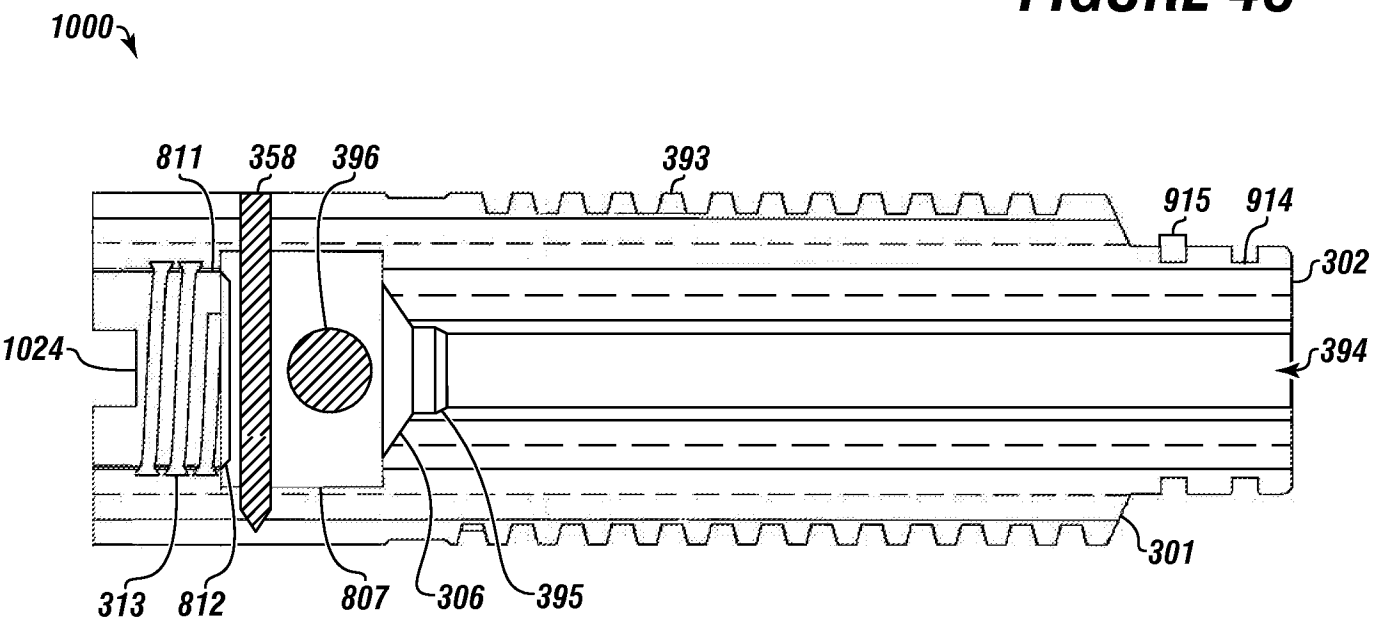
FIG. 4C depicts a schematic of a third caged ball setting mechanism according to one or more embodiments.

FIG. 4C depicts a schematic of a third caged ball setting mechanism 1000 according to one or more embodiments.

The third caged ball setting mechanism 1000 can include the extension 302 with an extension portal 394, a caged ball retaining rod 358 and a caged ball 396. The extension portal 394 can be used to allow for differential pressure between zones in a wellbore.

The third caged ball setting mechanism 1000 can also include the setting mechanism load shoulder 301 and the engaging threads 393.

The third caged ball setting mechanism 1000 can have a caged ball chamber 807 with a first diameter. The caged ball retaining rod 358 can be secured adjacent to the caged ball chamber 807. The caged ball retaining rod 358 can keep the caged ball 396 within the caged ball chamber 807.

An upper chamber 811 can be formed into the third caged ball plug 1000.

A setting tool stop 812 can be formed between the caged ball retaining rod 358 and the upper chamber 811.

The upper chamber 811 can have shear threads 313 formed therein.

The caged ball 396 can be guided by a caged ball seat guide 306 into the caged ball seat 395 when fluid pressure is applied.

The extension 302 can include one or more seal grooves 914. Each seal groove can have a seal 915 secured therein. The seals can be O-rings or the like.

The third caged ball setting mechanism 1000 can have a tightening groove 1024.

Figure 5:
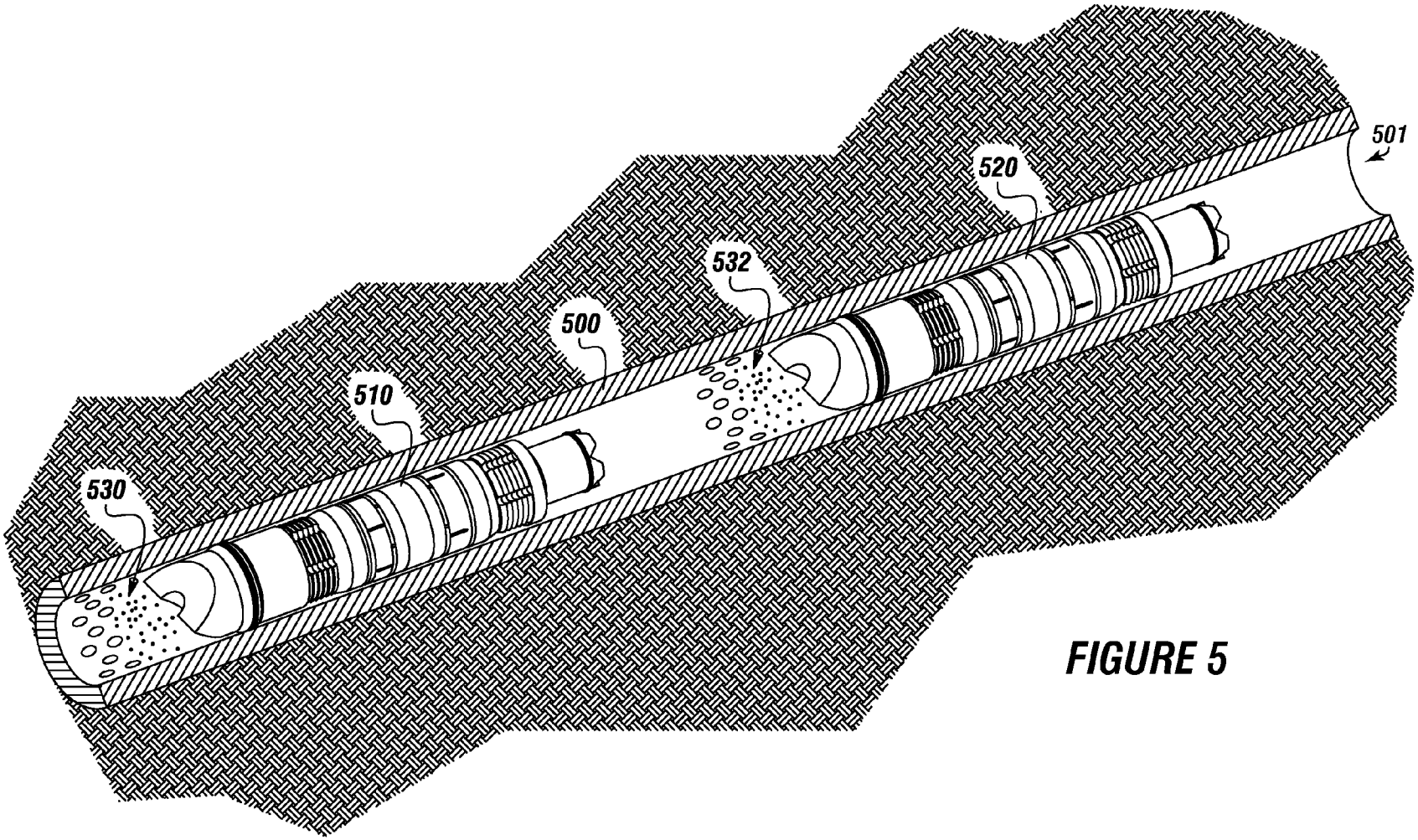
FIG. 5 is a schematic of two fractionation plugs disposed within a wellbore.

FIG. 5 is a schematic of two fractionation plugs disposed within a wellbore.

As depicted, the wellbore 501 can have a perforated casing 500 and two hydrocarbon bearing zones 530 and 532.

The embodiments of the fractionation plug described herein can be used within casing or within production tubing. For example, in one or more embodiments, the fractionation plug can be used within the wellbore casing.

In operation, coil tubing, wire lines, or other devices, which are not shown, can be used to place the fractionation plugs 510 and 520 into the wellbore 501. The fractionation plugs 510 and 520 can isolate the hydrocarbon bearing zones 530 and 532 from one another.

Once the plug is at a designated location, the setting tool can pull the mandrel, holding the outer components on the mandrel, which can compress the outer components, the slips, and the slip backups for engagement with the casing of the wellbore.

Once the plug is set in place, the casing in the wellbore can be perforated, such as with a well perforating gun.

Fractionation can be initiated by pumping water, sand and chemical through the wellbore into the plug forcing the caged ball to seat on the caged ball seat sealing off the lower fractionation zone from an upper fractionations zone. The plug can be left in place until the fractionation stage is completed.

FIG. 6 depicts a cross sectional view of a load ring disposed about a mandrel wherein one or more set screws are disposed through the load ring. The load ring 380 can be disposed about the mandrel 12. One or more shear pins 700*a* and 700*b* can be disposed through the load ring 380 and engage the mandrel 12. For example, the shear pins can extend $\frac{1}{8}^{th}$ of an inch into the mandrel 12. The shear pins 700*a* and 700*b* can prevent premature movement of the load ring 380.

FIG. 7 depicts a tapered nose cone having a beveled distal end. The removable nose cone 348 can have two slanted faces, one slanted face 709 is shown, and a pair of bevels 710 and 712 on a distal end thereof. The bevels 710 and 712 can be twenty degree bevels. The bevels help to reduce the risk of the removable nose cone 348 catching on a portion of a wellbore, reducing the likelihood of a premature set.

While these embodiments have been described with emphasis on the embodiments, it should be understood that within the scope of the appended claims, the embodiments might be practiced other than as described herein.

What is claimed is:

1. A caged ball fractionation plug for use in a wellbore comprising:

a. a mandrel having a crown engagement and a first setting mechanism receiving portion and a second setting mechanism receiving portion, wherein the crown engagement has a larger diameter portion with a diameter larger than the setting mechanism receiving portions, and wherein the setting mechanism receiving portions are between terminal ends of the mandrel, and wherein an anti-rotation ring is disposed on the larger diameter portion of the crown engagement;

b. a load ring slidably engaged to the mandrel;

c. a first slip disposed adjacent to the load ring;

d. a first slip backup adjacent the first slip on the mandrel;

e. a first lubricating spacer adjacent the first slip backup;

f. a first secondary seal adjacent the first lubricating spacer;

g. a primary seal adjacent the first secondary seal;

h. a second secondary seal adjacent the primary seal;

i. a second lubricating spacer adjacent the second secondary seal;

j. a second slip backup adjacent the second lubricating spacer;

k. a second slip adjacent the second slip backup;

l. a removable nose cone disposed over the mandrel adjacent the second slip, wherein the removable nose cone comprises:

(i) a nose cone body with an opening;

(ii) a dual tapered engagement integral with the nose cone body, wherein the tapered engagement comprises a first sloped face, and a second sloped face;

(iii) a central opening formed between the first sloped face and the second sloped face;

(iv) a pump down ring groove formed between the nose cone body and the tapered engagement for containing a pump down ring; and (v) a plurality of pressure relief grooves extending longitudinally, with each pressure relief groove disposed on an outer surface of the nose cone body; and m. a caged ball setting mechanism threaded into the first setting mechanism receiving portion between a facial seal located in the first setting mechanism receiving portion and the removable nose cone, wherein caged ball setting mechanism comprises:

(i) a caged ball setting mechanism body engaging the facial seal;

(ii) a setting mechanism load shoulder adjacent the shear device body;

(iii) an extension extending from the load shoulder; and (iv) an outer surface of the caged ball setting mechanism body for engaging internal threads of the first setting mechanism receiving portion, wherein the caged ball setting mechanism body comprises:

(a) an internal caged ball seat formed in the interface between a caged ball chamber and an extension portal;

(b) a caged ball seat guide adjacent the internal caged ball seat;

(c) a caged ball retaining rod adjacent the caged ball chamber;

(d) an upper caged ball chamber; and (e) shear threads formed in an inner surface of the upper caged ball chamber.

2. The caged ball fractionation plug of claim 1, wherein the caged ball retaining rod and the caged ball are each composed of a metal, a non-metallic composite or a combinations thereof.

3. The caged ball fractionation plug of claim 1, wherein the caged ball retaining rod extends across the second chamber.

4. The caged ball fractionation plug of claim 1, wherein the caged ball retaining rod has a diameter less than the central annulus.

5. The caged ball fractionation plug of claim 1, wherein the caged ball setting mechanism comprises left handed threads on the outer surface and right handed threads on the inner surface.

6. The caged ball fractionation plug of claim 1, wherein the mandrel comprises composite material.

7. The caged ball fractionation plug of claim 1, wherein the slips are metallic, non-metallic composite, or combinations thereof.

8. A caged ball fractionation plug for use in a wellbore comprising:

a. a mandrel;

b. a caged ball setting mechanism secured to a setting mechanism receiving portion, wherein the setting mechanism receiving portion is formed in the inner bore of the mandrel; wherein the caged ball setting mechanism comprises:

(i) an extension portal at a first distal end thereof;

(ii) a caged ball chamber adjacent the extension portal, wherein the caged ball chamber has an opened end and an end with a caged ball seat formed therein;

(iii) a caged ball seat guide adjacent the caged ball seat;

(iv) a caged ball located in the caged ball chamber; and (v) a retaining rod located between the caged ball and the opened end of the caged ball chamber;

c. a load ring disposed on the mandrel adjacent the crown engagement;

d. a first slip disposed adjacent to the load ring;

e. a first slip backup adjacent the first slip on the mandrel;

f. a first lubricating spacer adjacent the first slip backup, wherein the first lubricating spacer is tapered at one side to fit into the first slip backup;

g. a first secondary seal adjacent the first lubricating spacer;

h. a primary seal adjacent the first secondary seal;

i. a second secondary seal adjacent the primary seal;

j. a second lubricating spacer adjacent the second secondary seal, wherein the second lubricating spacer is tapered at one side to fit into the second slip backup;

k. a second slip backup adjacent the second lubricating spacer;

l. a second slip adjacent the second slip backup; and m. a tapered nose cone connected with the mandrel, wherein the tapered nose cone comprises two slanted faces.

* * * * *